United States Patent [19]

Gross, Jr. et al.

[11] Patent Number: 4,583,812

[45] Date of Patent: Apr. 22, 1986

[54] ELECTRICAL CONTACT WITH ASSIST SPRING

[75] Inventors: Robert E. Gross, Jr., Elizabethtown; Teresa K. Heck, New Cumberland, both of Pa.; William P. Sturner, Cherry Hill, N.J.; Yew-Thye Yeow, Harrisburg, Pa.

[73] Assignee: AMP Incorporated, Harrisburg, Pa.

[21] Appl. No.: 625,998

[22] Filed: Jun. 29, 1984

[51] Int. Cl.[4] ..... H01R 13/18

[52] U.S. Cl. ..... 339/259 R

[58] Field of Search ..... 339/259 R, 259 F

[56] References Cited

U.S. PATENT DOCUMENTS

| | | | |
|---|---|---|---|
| 1,589,066 | 6/1926 | Gibbons | 339/259 F |
| 2,704,838 | 3/1955 | Macha et al. | 339/259 |
| 3,836,947 | 9/1974 | Yeager | 339/259 R |
| 4,219,252 | 8/1980 | Fisher | 339/259 R |
| 4,341,434 | 7/1982 | Pfister | 339/259 R |
| 4,540,235 | 9/1985 | Lolic | 339/259 F |

FOREIGN PATENT DOCUMENTS

| | | | |
|---|---|---|---|
| 1487407 | 2/1966 | Fed. Rep. of Germany | 339/259 R |
| 1427747 | 4/1966 | France | 259 R/ |

OTHER PUBLICATIONS

AMP Catalog 73-204 revised Jun. 1983 p. 35, "CPC (Circular Plastic) and Metal-Shell CPC Connectors" (AMP Incorporated).

*Primary Examiner*—Neil Abrams

*Attorney, Agent, or Firm*—Anton P. Ness

[57] ABSTRACT

A stiff assist spring is secured around a receptacle contact having opposed spaced contact arms extending forward from a body portion thereof to receive a plug terminal insertably therebetween, said assist spring having spring arms coextensive with and outside said contact arms and extending from base sections interconnected by an integral bridge section straddling said contact arms proximate said body portion, such that said spring arms resist the widening of the contact arms by the insertion of said plug terminal.

15 Claims, 4 Drawing Figures

ELECTRICAL CONTACT WITH ASSIST SPRING

FIELD OF THE INVENTION

This relates to the field of electrical contact terminals, and more particularly to receptacle contacts.

BACKGROUND OF THE INVENTION

Receptacle contacts are known which have a pair of opposing contact arms extending forward from a main body portion between which is insertable a male or plug terminal. The contact arms act as spring members and tend to converge first toward each other to a closest point and then diverge forming a lead-in for a plug terminal. At the closest point the contact arms are at a distance from each other less than the width of the plug terminal so that when the plug terminal is inserted between the contact arms, the contact arms are forced apart by the plug terminal, but because of their spring nature the contact arms maintain a contact force against the plug terminal and thus maintain electrical engagement therewith. Generally, the greater the contact force, the better the integrity and quality of the electrical engagement, but necessitating higher insertion force.

Especially in power-conducting terminal connections, high quality electrical engagement is critical and is dependent not only on high contact force but also upon the use of high grade conductive metal such as alloys having high copper content. Contact arms made from such alloys have relatively low resilience because of the low yield stress of copper. As a results, receptacle contacts of such metal have contact arms which do not have strong spring characteristics and thus do not provide high contact force against the plug terminal.

One particular prior art method of compensating for low resilience in the contact arms of a receptacle contact was the use of an anti-overstress spring which straddled the base sections of the contact arms, had arm sections coextending along the outer surfaces of the contact arms to their inward-most point. Then the arm sections of the spring were doubled back for some distance before ending; such doubled-back sections were designed to engage the sidewalls of the housing cavity in order to provide support to the contact arms near the forward ends of the contact arms which increased the contact force of the contact arms against the plug terminal inserted between the contact arms. Such an arrangement relied heavily on the cavity walls retaining a definite width dimension, and because of heat buildup in the housing this dimension changed due to expansion of the housing material making the performance parameters of the anti-overstress spring variable and thus unreliable.

SUMMARY OF THE INVENTION

An assist spring is provided for a receptacle contact which substantially increases the contact force of the arms of the receptacle contact against the plug terminal inserted therebetween. The assist spring, made of stiffly resilient metal such as stainless steel, comprises two cantilever spring arms extending from a body portion thereof, the spring arms being disposed along and proximate to outer surfaces of the contact arms of the receptacle contact, and the body portion securely straddling the contact arms proximate the body portion of the receptacle contact. When a plug terminal is inserted between the contact arms of the receptacle contact and forces them apart, the outer surfaces engage (primarily at one point near the ends of the arms) the spring arms of the assist spring which provides substantially increased resistance to being urged apart by the plug terminal and thus provides greater contact force between the contact arms and the plug terminal.

DETAILED DESCRIPTION OF THE PREFERRED EMBODIMENT

Figures 1, 2, 3, 4:
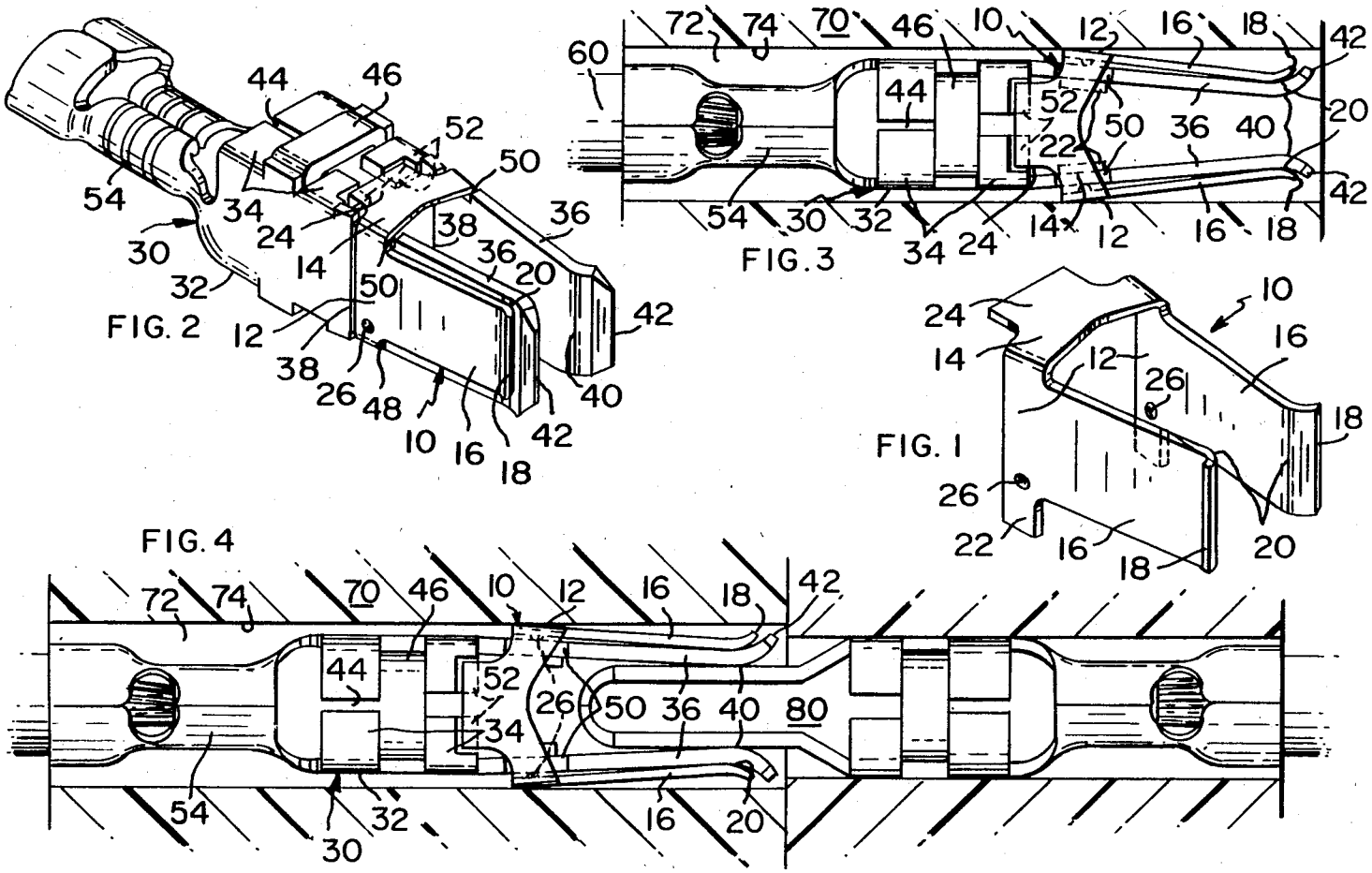
FIG. 1 shows an assist spring of the present invention in perspective.
FIG. 2 is a perspective of the assist spring of FIG. 1 assembled to a receptacle contact.
FIG. 3 is a plan view of the assembly of FIG. 2 disposed in a housing cavity.
FIG. 4 shows a plug terminal inserted into the receptacle contact of FIG. 3.

With reference to FIG. 1, assist spring 10 has opposing base sections 12, a bridge section 14 extending normally therebetween, and spring arms 16 extending forward from base sections 12 and angled toward each other. End sections 18 of spring arms 16 diverge from an engagement area 20 which area 20 is the closest distance between spring arms 16.

In FIG. 2, a receptacle contact 30 has a body portion 32 (generally having a top surface 34) and integral contact arms 36 extending forwardly from jointures 38 with body portion 32 and converging somewhat to contact sections 40 on inner surfaces thereof. Forward of contact sections 40 end sections 42 of contact arms 36 diverge to form a lead-in for receiving a male or plug terminal (not shown) insertably thereinto. Receptacle contact 30 is typically stamped and formed of high copper alloy, and typically has a seam 44 in top surface 34. Receptacle contact 30 may typically contain a compressible plastic latching spring 46 for latching contact 30 within a cavity 72 of a connector housing 70, as shown in FIG. 3, plastic latching spring 46 normally extending from above top surface 34 of contact 30 to below the bottom surface thereof and is compressed during insertion of contact 30 into cavity 72 and snaps outwardly after passing between and past stop shoulders or ledges in the top and bottom cavity walls thus latching the contact in the cavity.

Assist spring 10 is assembled to receptacle contact 30 with spring arms 16 extending along outer surfaces of contact arms 36 and proximate thereto and preferably not in engagement therewith therealong. Support areas 20 of spring arms 16 are proximate contact sections 40 of contact arms 36 but are outside of contact arms 36. Base sections 12 of assist spring 10 are secured to contact arms 36 adjacent jointures 38, where contact arms 36 join body portion 32, and bridge section 14 extends across the gap between the contact arms 36 just forward of jointures 38. Tabs 22 of assist spring 10 which extend downward from base sections 12 are bent around the bottom of each contact arm to secure assist spring 10 to receptacle contact 30. It is preferred that notches 48 are formed in bottom edges of contact arms 36 wherein tabs 22 may be more effectively secured. Similarly, it is preferred that notches 50 be formed in top edges of contact arms 36 proximate body portion 32 so that bridge section 14 may be more effectively secured against any substantial axial movement with respect to receptacle contact 30. When secured to receptacle contact 30, bridge section 14 preferably is disposed to extend across that side of the receptacle contact 30 containing seam 44, whcih tends to prevent receptacle contact 30 from opening along seam 44.

Assist spring 10 preferably has a large tab 24 extending rearwardly from bridge section 14 which rests on ledges 52 formed on body portion 32 of contact 30, which ledges 52 have respective aligned top surfaces which are spaced downwardly from top surface 34 of body portion 32. Such an arrangement allows for there to be substantially no engagement between assist spring 10 and top surfaces of contact arms 36 at notches 50. Assist spring 10 also preferably has inwardly extending projections such as dimples 26 on base sections 12 proximate tabs 22 which project inwardly to engage contact arms 36 and space base sections 12 from contact arms 36 near the bottom thereof. As a result, base sections 12 are held spaced from, and preferably do not come into engagement with, contact arms 36 allowing longer in-service life of the receptacle contact assembly.

With reference to FIG. 3, receptacle contact 30 has a conductor-receiving section 54 which has been terminated to a conductor 60 by crimping or other conventional method, and the assembly has been secured in a cavity 72 of a dielectric housing 70. Base sections 12 of assist spring 10 may engage walls 74 of cavity 72 of the housing. End sections 42 of contact arms 36 extend to the end of cavity 72 to receive a plug terminal therebetween.

As shown in FIG. 4, plug terminal 80 is inserted into receptacle contact 30 between contact arms 36 and forces contact arms 36 apart, plug terminal 80 being wider than the distance between contact areas 40 of contact arms 36. When outer surfaces of nonstiff contact arms 36 immediately or almost immediately engage stiff spring arms 16 at support areas 20, they meet substantial mechanical resistance to being further widened, spring arms 16 acting as cantilever arms held by base sections 12. This mechanical resistance by spring arms 16 provides substantial normal force against plug terminal 80, thus providing greater electrical contact force between contact areas 40 of contact arms 36, and corresponding contact surfaces on plug terminal 80, thus providing high integrity electrical engagement which is especially needed for power conductor connections. This reduces in power and the corresponding generation of heat. The mechanical resistance provided by the assist spring results from the cantilever nature of the spring arms supported only by being joined to base sections of the assist spring, and not to the ends of the spring arms engaging a cavity wall for support.

It will be apparent that various changes may be made to the assist spring of the present invention, without departing from the spirit or scope of the invention or sacrificing all its material advantages. The example provided herein is merely a preferred embodiment of the invention.

What is claimed is:

1. An assist spring for an electrical receptacle contact, said receptacle contact having opposing contact arms spaced therebetween extending forwardly from a body portion thereof for electrical engagement with a plug terminal insertable therebetween, said assist spring being stiff and comprising opposing resilient cantilever spring arms extending forward from parallel base sections in spaced apart relationship, said base sections being interconnected by an integral bridge section therebetween, said assist spring being secured around said receptacle contact by having said base sections disposed along outside surfaces of respective said contact arms proximate said body portion and each said base section having an inwardly extending projection to engage a respective said outside surface to space said base section from said respective contact arm, said bridge section straddling said contact arms proximate said body portion, and said spring arms extending along and proximate to outside surfaces of said contact arms, each spring arm having a support area near a forward end thereof for its associated said contact arm to be brought into engagement therewith upon said contact arms being urged more widely apart by a said plug terminal being inserted between said contact arms, said support areas being substantially unrestrained against relative axial movement along said outside surfaces of said contact arms, whereat and whereupon said spring arms substantially resist said widening of said contact arms thereby providing greater contact force between said contact arms and said plug terminal, solely by reason of said resilient cantilever spring arms.

2. An assist spring as set forth in claim 1 wherein said assist spring is stamped and formed of stainless steel.

3. An assist spring as set forth in claim 1 wherein each said base section has a tab extending therefrom bendable around a respective edge of an associated said contact arm opposed from said bridge section to secure said assist spring to said contact arms.

4. An assist spring as set forth in claim 1 wherein said bridge section has a large rearwardly extending tab engaging ledge means on said body portion of said receptacle contact, said large tab being disposed atop said ledge means.

5. An assist spring as set forth in claim 3 wherein said tabs of said base sections extend through notches in said edges of said contact arms, and said bridge section extends through notches in opposite edges of said contact arms where said bridge section integrally joins each said base section.

6. An assist spring as set forth in claim 1 wherein said bridge section is disposed across a seamed side of said receptacle contact.

7. As assist spring as set forth in claim 1 wherein free ends of said spring arms are curved outwardly.

8. An assist spring for an electrical receptacle contact, said receptacle contact having opposing contact arms spaced therebetween extending forwardly from a body portion thereof for electrical engagement with a plug terminal insertable therebetween, said assist spring being stiff and comprising.

a bridge section which straddles said contact arms proximate said body portion when said assist spring is secured to said receptacle contact;

a large tab extending rearwardly from said bridge section which is disposed atop and engages ledge means on said body portion of said receptacle contact, spacing said bridge section outwardly from said body portion;

a pair of base sections extending integrally normally to said bridge section from lateral sides thereof and substantially parallel to each other, said base sections being disposed along outside surfaces of said contact arms proximate said body portion of said receptacle contact;

a tab extending from a bottom end of each said base section and bendable around a respective edge of an associated said contact arm to secure said assist spring to said contact arms;

an inwardly extending projection on each said base section proximate a respective said tab to engage a surface of a said associated contact arm to space said base section from said contact arm; and opposing resilient cantilever spring arms extending integrally forwardly from respective said base sections, said spring arms extending along and proximate to outside surfaces of said contact arms and ending in outwardly curved free ends, each spring arm having a support area near a respective said free end thereof for its associated said contact arm to be brought into engagement therewith upon said contact arms being urged more widely apart by a said plug terminal being inserted between said contact arms, said support areas being substantially unrestrained against relative axial movement along said outside surfaces of said contact arms, whereat and whereupon said spring arms substantially resist said widening of said contact arms thereby providing greater contact force between said contact arms and said plug terminal, solely by reason of said resilient cantilever spring arms.

9. An electrical receptacle contact assembly of an electrical receptacle contact and an assist spring secured thereto comprising:

a receptacle contact of the type including a conductor receiving section and having opposing contact arms extending forwardly from a body portion in spaced apart relationship for electrical engagement with a plug terminal insertable therebetween, said receptacle contact being made of high grade conductive metal having low yield stress; and a stiff stamped and formed assist spring secured thereto and therearound having a bridge section, substantially parallel base sections extending integrally normally from lateral sides thereof, and opposing resilient cantilever spring arms extending integrally forwardly from respective said base sections, said bridge section being disposed straddling said contact arms proximate said body portion, said base sections being disposed along outside surfaces of respective said contact arms proximate said body portion and spaced therefrom by inwardly directed projections of said base sections engaging said outside surfaces and said spring arms extending along and proximate to said outside surfaces of said contact arms, each said spring arm having a support area near a forward end thereof for its associated said contact arm to be brought into engagement therewith upon said contact arm being urged more widely apart by a said plug terminal being inserted between said contact arms, said support area being substantially unrestrained against relative axial movement along said outside surfaces of said contact arms, whereat and whereupon said spring arms substantially resist said widening of said contact arms thereby providing greater contact force between said contact arms and said plug terminal, solely by reason of said resilient cantilever spring arms.

10. An electrical receptacle contact assembly as set forth in claim 9 wherein said assist spring is stamped and formed of stainless steel.

11. An electrical receptacle contact assembly as set forth in claim 9 wherein each said base section has a tab extending therefrom bendable around a respective edge of an associated said contact arm opposed from said bridge section to secure said assist spring to said contact arms.

12. An electrical receptacle contact assembly as set forth in claim 9 wherein said bridge section has a large rearwardly extending tab engaging ledge means on said body portion of said receptacle contact, said large tab being disposed atop said ledge means and spacing said bridge section outwardly from said body portion.

13. An electrical receptacle contact assembly as set forth in claim 11 wherein said tabs of said base sections extend through notches in said edges of said contact arms, and said bridge section extends through notches in opposite edges of said contact arms where said bridge section integrally joins each said base section.

14. An electrical receptacle contact assembly as set forth in claim 9 wherein said bridge section is disposed across a seamed side of said receptacle contact.

15. An electrical receptacle contact assembly as set forth in claim 10 wherein free ends of said spring arms are curved outwardly.

* * * * *